US006899660B1

(12) United States Patent
Chin et al.

(10) Patent No.: US 6,899,660 B1
(45) Date of Patent: May 31, 2005

(54) WALKER FOR REHABILITANT

(75) Inventors: Kao Chin Chin, Hsin Tien (TW); Wang Jen Cheng, Hsin Tien (TW); Tin Cheng Shing, Hsin Tien (TW)

(73) Assignee: Dynamic Healthtech Inc., Taipei (TW)

( * ) Notice: Subject to any disclaimer, the term of this patent is extended or adjusted under 35 U.S.C. 154(b) by 0 days.

(21) Appl. No.: 10/777,835

(22) Filed: Feb. 11, 2004

(51) Int. Cl.[7] ..... A61H 3/04; A63B 22/20

(52) U.S. Cl. ..... 482/66; 482/69; 602/32; 135/85

(58) Field of Search ..... 482/66, 67–69, 482/148; 135/65, 67, 85; 602/32–36

(56) References Cited

U.S. PATENT DOCUMENTS 2,719,568 A * 10/1955 Webb ..... 482/68
5,476,432 A * 12/1995 Dickens ..... 482/67
5,569,129 A * 10/1996 Seif-Naraghi et al. ..... 482/69
5,800,318 A * 9/1998 Coviello ..... 482/68
5,853,015 A * 12/1998 Evans ..... 135/67
6,003,532 A * 12/1999 Pi ..... 135/67
6,139,475 A * 10/2000 Bessler et al. ..... 482/69

* cited by examiner

*Primary Examiner*—Stephen R. Crow
(74) *Attorney, Agent, or Firm*—W. Wayne Liauh

(57) ABSTRACT

A walker particularly suitable for rehabilitation of a patient's legs includes a base provided with casters, a pair of handlebars, and a suspension frame for holding a safety belt. A leg separator is height-adjustably connected to the base to locate between and separate apart the patient's two legs, so that a cerebral palsied patient may bear inner sides of two legs against two lateral sides of the leg separator during practicing walking. Direction control members adapted to limit the casters to rotate forward and backward only are provided on the base to effectively enable the cerebral palsied patient to practice walking straightly forward.

2 Claims, 7 Drawing Sheets

WALKER FOR REHABILITANT

FIELD OF THE INVENTION

The present invention relates to a walker for rehabilitant, and more particularly to a walker having a leg separator for a patient to bear inner sides of two legs against the leg separator and thereby keep walking forward in a straight line.

BACKGROUND OF THE INVENTION

A patient who is completely or partially disabled due to illness or accident requires rehabilitation to restore his ability of movement. A walker plays an important role in assisting the patient in practicing walking during rehabilitation.

A walker for rehabilitant must have a base equipped with casters to enable easy and smooth movement of the walker, handlebars for the patient to grip at comfortably, and a suspension frame for holding a safety belt to secure the patient's safety during practicing walking.

It is known a cerebral palsied patient tends to bend two knees inward when the patient is walking, causing two legs to mutually interfere with one another. That is, the cerebral palsied patient's body tends to incline toward one side, preventing the patient from walking in a straight line and increasing the difficulty in rehabilitation. Moreover, the inclined body and the mutually interfered legs of the cerebral palsied patient would inevitably cause the walker to move non-linearly and lose its function of assisting the patient in walking straightly.

SUMMARY OF THE INVENTION

It is a primary object of the present invention to provide a walker for rehabilitant that includes a leg separator, so that a patient may bear inner sides of two knees against two lateral sides of the leg separator while practicing walking. The provision of the leg separator helps training of the patient's leg muscles to drive the knees and ankles to bend in correct directions for the patient to always move forward in a straight line.

In a preferred embodiment of the present invention, the leg separator may be easily adjusted to different heights to adapt to different users.

Another object of the present invention is to provide a walker for rehabilitant, in which direction control members are provided to limit the walker to linearly move forward or backward only, and therefore help training of patients to walk in a straight line.

To achieve the above and other objects, the walker for rehabilitant according to the present invention mainly includes a base provided at predetermined positions with caster holders, a handlebar assembly connected to an upright hollow column provided on a top of the base, a suspension frame connected to an upper end of the hollow column, and a leg separator connected to a rear center of the base.

The leg separator includes a perpendicular leg separating board, and an L-shaped fixing bar, which has a horizontal section connected at a front end to the base and a vertical section connected to a front end of the leg separating board. The leg separating board is located between and separates apart the patient's two legs, so that a cerebral palsied patient may bear inner sides of two knees against two lateral sides of the leg separating board during practicing walking straightly.

To enable adjustment of the leg separator to a desired height for the patient, the leg separating board is provided at the front end with a vertical row of at least three pin holes. By extending pins through pin holes on the fixing bar and the leg separating board at different heights, the leg separating board may be fixed at different heights.

The base is also provided above each caster holder with a pivotally turnable direction control member, which has a front part shaped for enclosing two lateral sides of the caster holder when the direction control member is in a downward turned position, and the direction control member in the downward turned position is able to limit the caster holder, and accordingly a caster connected thereto, to move forward or backward only.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
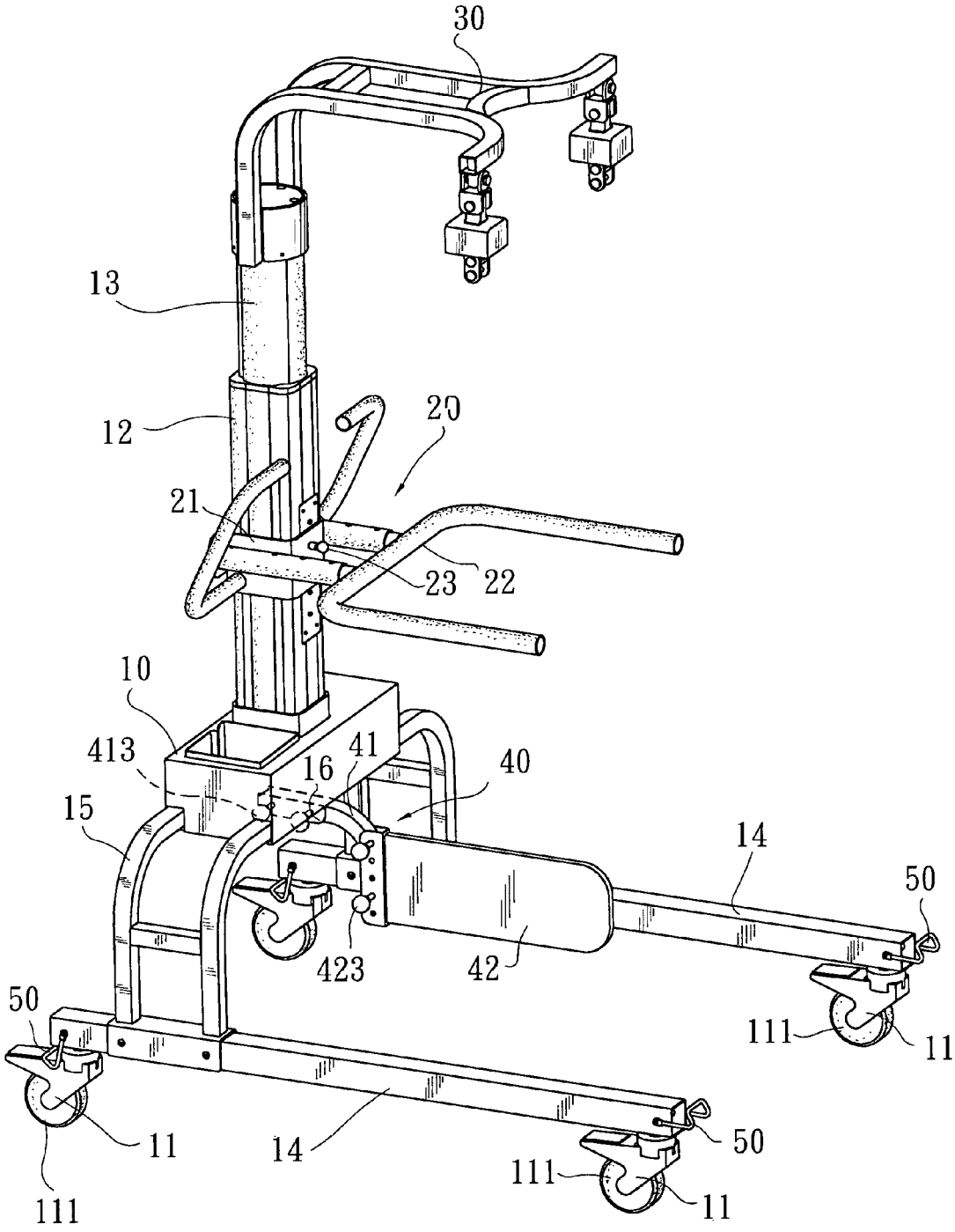
FIG. 1 is a perspective view of a walker for rehabilitant according to an embodiment of the present invention.

Please refer to FIG. 1 that is a perspective view of a walker for rehabilitant according to an embodiment of the present invention. As shown, the walker mainly includes a base 10 provided with caster holders 11, a handlebar assembly 20, and a suspension frame 30.

The base 10 includes an upright hollow column 12, to which the handlebar assembly 20 is connected. An inner tubular member 13 is telescoped in the hollow column 12, and the suspension frame 30 is connected to an upper end of the tubular member 13. The base 10 also includes a left and a right horizontal leg 14. The caster holders 11 are separately connected to lower front and lower rear ends of the two legs 14 to hold four casters 111 thereto. An inverted U-shaped frame 15 is connected at lower ends to a top of the left and the right leg 14, so that the two legs 14 are parallelly connected to each other with a space left between them. The hollow column 12 is fixedly connected at a lower end to a top of the inverted U-shaped frame 15. A leg separator 40 is fixedly connected at a front end to a rear center of the inverted U-shaped frame 15, so that a separating board 42 of the leg separator 40 is perpendicularly located between the left and the right leg 14.

Figure 3:
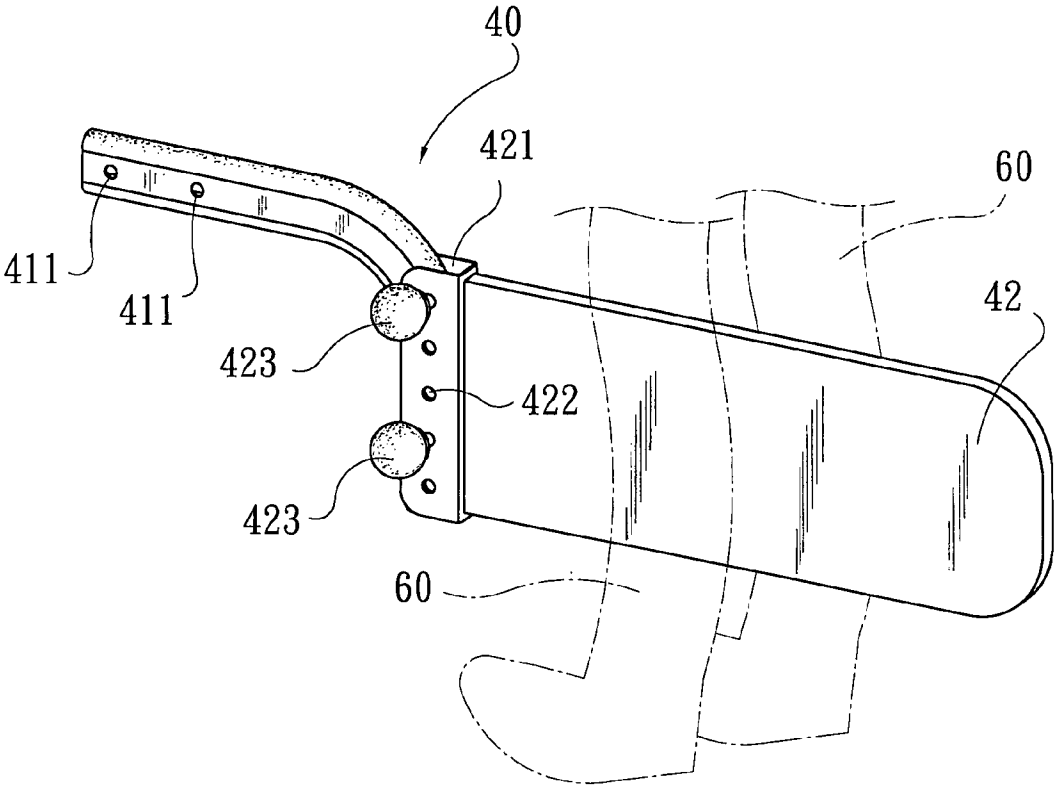
FIG. 3 shows the use of the leg separator of FIG. 2 to separate apart a rehabilitant's two legs.

Please refer to FIG. 3. To use the walker of the present invention, a rehabilitant, such as a cerebral palsied patient, may stand behind the walker to straddle the leg separating board 42, so as to bear inner sides of two legs 60 against two lateral sides of the leg separating board 42. In this manner, the patient's legs 60 are prevented from bending inward but guided to bend forward. The forward bending of legs tends to gradually strengthen the patient's leg muscles for knees and ankles to bend forward. After a period of time, the patient's two legs 60 will have leg muscles strong enough to cause the knees and ankles to naturally bend forward, enabling the patient to walk better.

Figure 2:
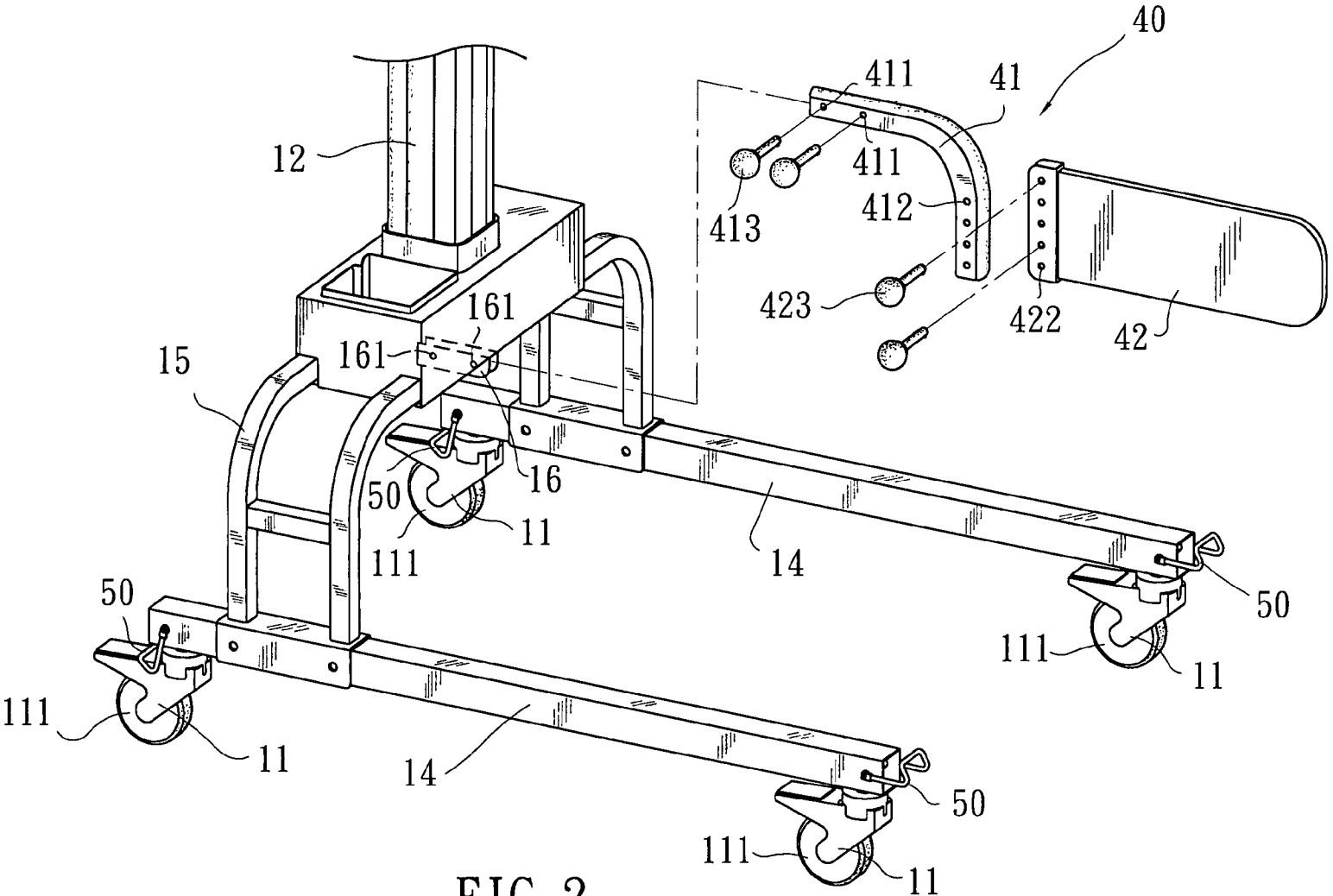
FIG. 2 is an exploded perspective view of a leg separator included in the present invention.
Figure 4:
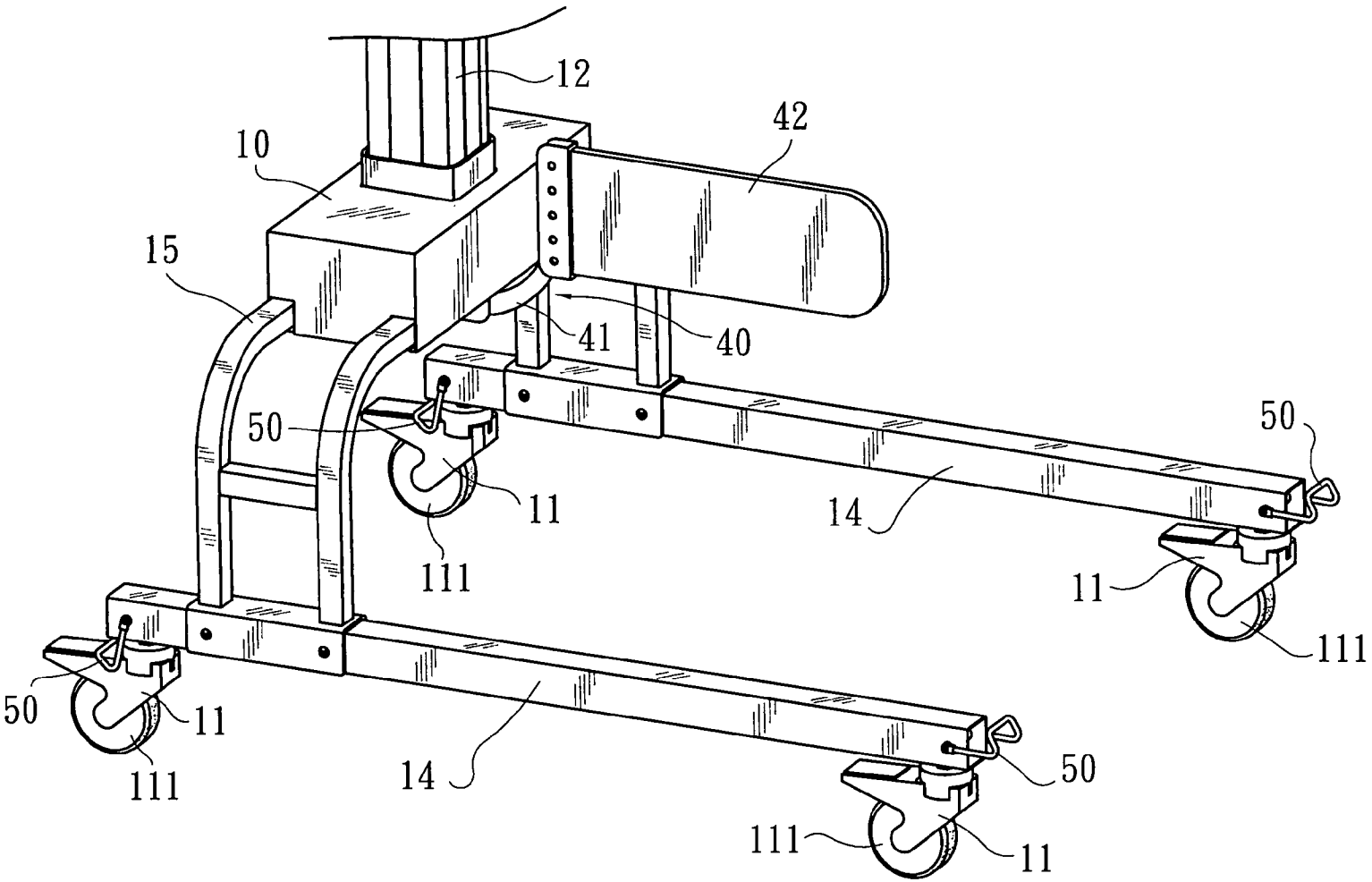
FIG. 4 is an assembled view of FIG. 2.

FIG. 2 is an exploded view of the leg separator 40. As shown, the leg separator 40 includes a substantially L-shaped fixing bar 41 and a leg separating board 42. A horizontal section of the L-shaped fixing bar 41 is connected at a free end to a lengthwise horizontal channel 16 provided at a predetermined point on the base 10, and a vertical section of the L-shaped fixing bar 41 is securely connected to a front end of the leg separating board 42. By extending two insertion pins 413 through holes 161 formed on the channel 16 and pin holes 411 formed on the horizontal section of the fixing bar 41, the L-shaped fixing bar 41 is secured to the base 10. The leg separating board 42 is provided along a front end with a vertical groove 421 adapted to receive the vertical section of the L-shaped fixing bar 41 therein. By extending at least two insertion pins 423 through two of many holes 422 formed on the vertical groove 421 and two of many pin holes 412 formed on the fixing bar 41, the leg separating board 42 is connected to the fixing bar 41. It is noted at least two pin holes 412 are formed on the vertical section of the L-shaped fixing bar 41, and at least three holes 422 are formed on the vertical groove 421 of the leg separating board 42. By extending the at least two insertion pins 423 through two holes 422 and 412 at different heights, the leg separating board 42 may be fixed to the L-shaped fixing bar 41 at a desired height. Moreover, the L-shaped fixing bar 41 may be connected to the base 10 with the vertical section pointed downward as shown in FIG. 1, or pointed upward as shown in FIG. 4.

As mentioned above, the base 10 includes two legs 14 that are connected to each other by the inverted U-shaped frame 15 to form a supporting structure of the walker. The inverted U-shaped frame 15 defines a considerably large space below it to allow positioning of a commercially available walking machine (not shown) thereat. This design allows the patient to practice walking without moving the walker. That is, the patient may practice walking even in a small room. In the case a walking machine is positioned below the walker of the present invention, the leg separator 40 should be mounted with the vertical section of the L-shaped fixing bar 41 pointed upward, as shown in FIG. 4, so that the leg separating board 42 is located higher relative to the base 10 to produce the exact effect of separating the patient's two legs 60 standing on the walking machine.

The caster holders 11 connected to lower front and lower rear ends of the two legs 14 are freely turnable by 360 degrees, enabling the walker to be easily turned to any desired direction. The two legs 14 are also provided at upper front and upper rear ends with four direction control members 50, which may be pivotally turned between a released position, in which the direction control member 50 are located above the legs 14, and a locked position, in which the direction control members 50 are separately enclosing two lateral sides of the caster holders 11.

Figure 6:
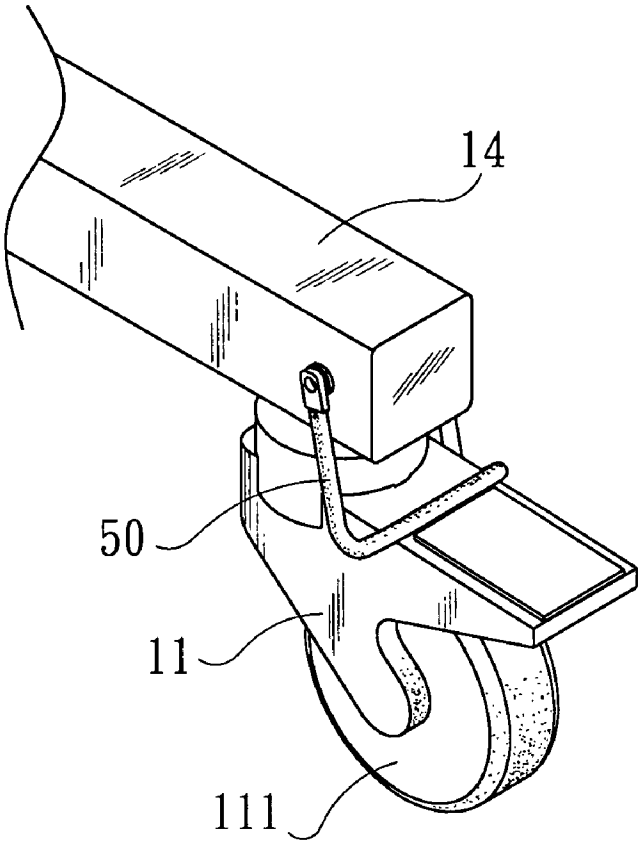
FIG. 6 is similar to FIG. 5 with the direction control member in a locked position to limit the caster to a fixed forward direction.
Figure 5:
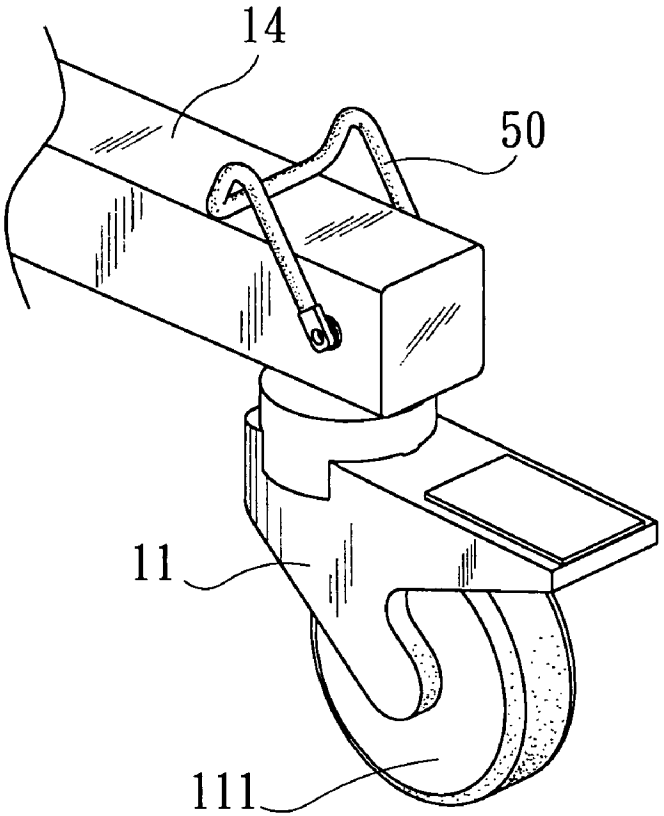
FIG. 5 shows one caster of the walker of the present invention with a direction control member in a released position.

Each of the direction control members 50 includes a length of bent steel wire, which has a front part shaped for enclosing two lateral sides of the caster holder 11 when the direction control member 50 is pivotally turned downward to the locked position. With the direction control member 50 pivotally turned downward to the locked position, the caster holder 11 is limited to a direction in which the leg 14 extends, as shown in FIG. 6. At this point, the caster 111 connected to that caster holder 11 is limited to rotate forward or backward for the walker to move linearly. On the other hand, when the direction control member 50 is pivotally turned upward to the released position, as shown in FIG. 5, the caster holder 11 is allowed to turn freely. By limiting the walker to move linearly, it is possible to train a cerebral palsied patient to walk in a straight line.

Figure 7:
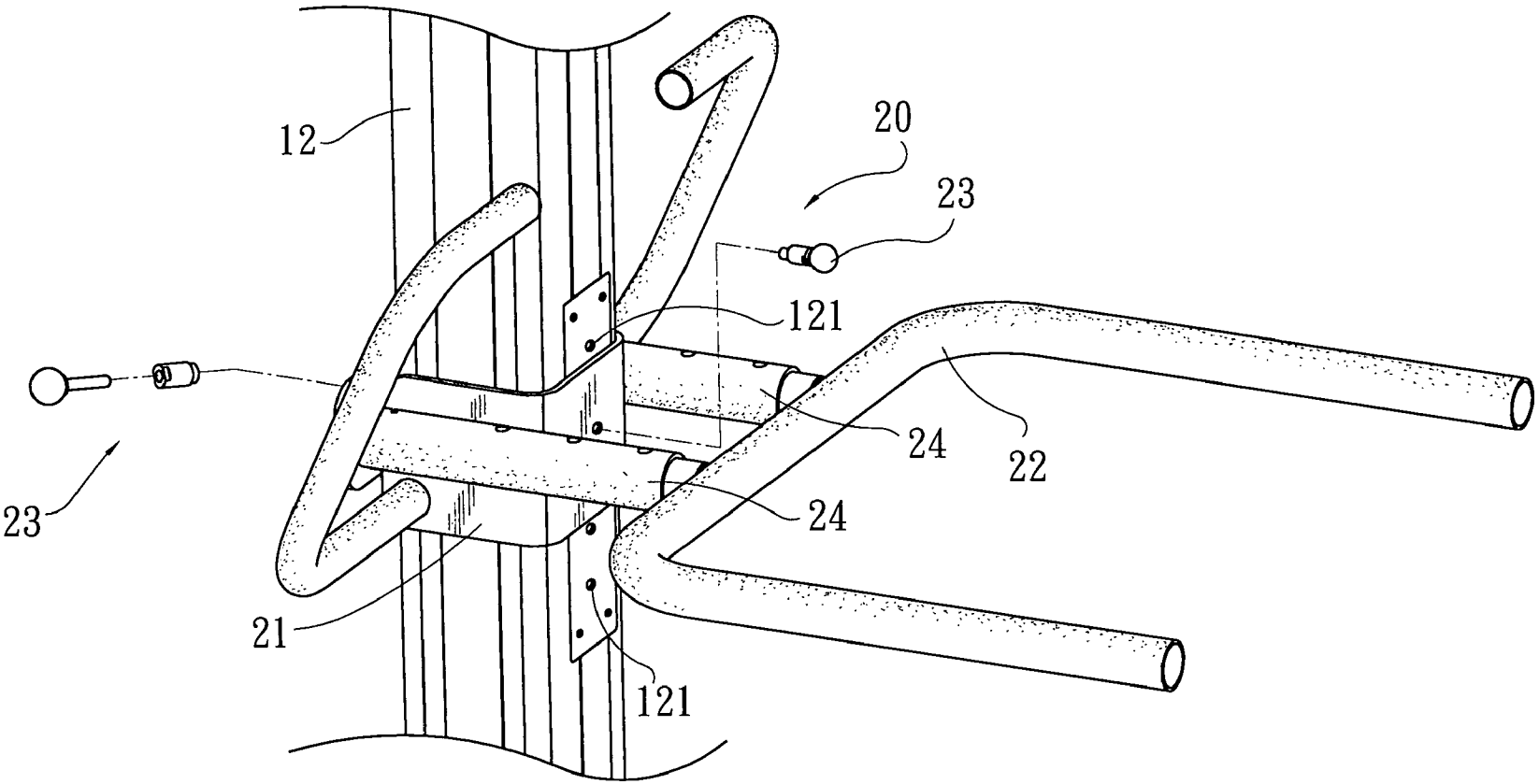
FIG. 7 shows a handlebar assembly included in the present invention.

Please refer to FIG. 7 that shows the handlebar assembly 20 for the walker of the present invention. As shown, the handlebar assembly 20 mainly includes a sleeve 21 upward and downward slidably mounted around the hollow column 12 on the base 10, and a pair of handlebars 22 connected to a rear side of the sleeve 21 for the patient to grip at. By extending two spring pins 23 separately provided on a front and a rear side of the sleeve 21 into two corresponding pin holes 121 included in two vertical rows of pin holes 121 separately provided on a front and a rear wall of the hollow column 12, the sleeve 21 may be fixed to the hollow column 12 at a desired height. The handlebars 22 are connected to the sleeve 21 by extending front ends of the handlebars 22 into two tubes 24 fixedly provided on the sleeve 21. Pin holes may be provided along the two tubes 24 to allow the handlebars 22 to insert and locate in the tubes 24 by different depths.

The suspension frame 30 is connected to the upper end of the tubular member 13 telescoped in the hollow column 12. The tubular member 13 is driven by a suitable mechanism (not shown) to slide upward and downward in the hollow column 12. Since this is a known art, it is not discussed in details herein. The suspension frame 30 is mainly used to hold a safety belt (not shown) that is hung from the suspension frame 30 and adapted to enclose the patient's back and hips. When the patient is tired during practicing walking, the safety belt serves as a seat for the patient to take a rest.

Figure 8:
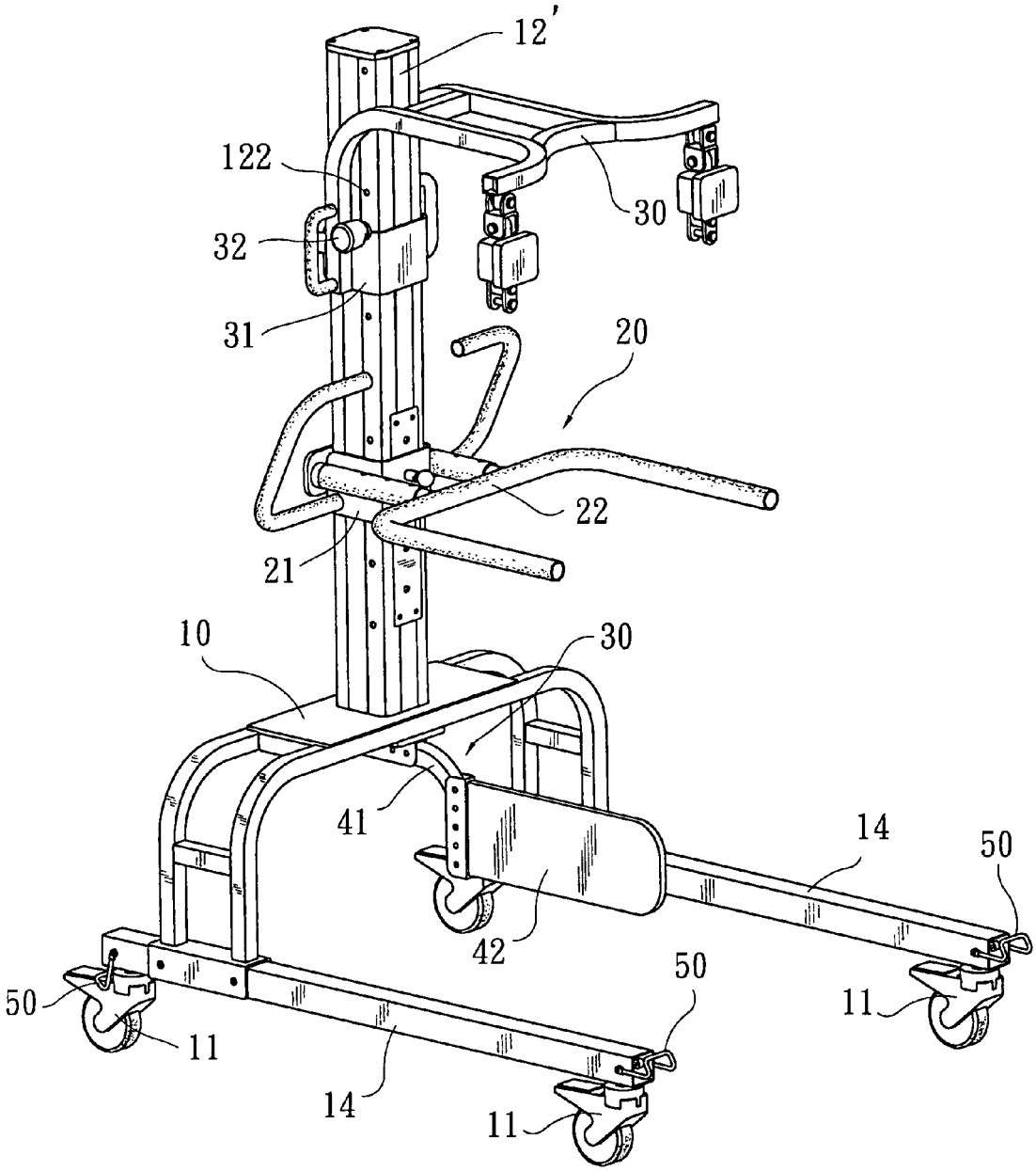
FIG. 8 is a perspective view of a walker for rehabilitant according to another embodiment of the present invention.

The tubular member 13 of the walker for rehabilitant may be electrically driven to slide upward and downward in the hollow column 12, so as to ascend or descend the suspension frame 30. In an alternative embodiment of the present invention, the walker includes an upright hollow column 12' that does not have a tubular member telescoped therein, as shown in FIG. 8. In this case, the suspension frame 30 is connected to a sleeve 31 that is upward and downward slidably mounted around the column 12'. Two spring pins 32 (only one is shown in the drawing) are provided at two opposite sides of the sleeve 31 for inserting into two selected pin holes 122 included in two vertical rows of pin holes 122 correspondingly formed at two opposite sides of the column 12'. By extending the two spring pins 32 into two corresponding pin holes 122, the sleeve 32 and accordingly, the suspension frame 30, may be located at a desired height.

With the leg separator 40 and the direction control members 50, the walker of the present invention has expanded application for cerebral palsied patients to obtain good rehabilitation effect. Moreover, the leg separator 40 may be mounted in different manners and adjusted to different heights and therefore enables the walker for rehabilitant to use with a walking machine.

What is claimed is:

1. A walker for rehabilitation, comprising a base provided at predetermined positions with caster holders, a handlebar assembly connected to an upright hollow column provided on a top of said base, a suspension frame connected to an upper end of said hollow column, and a leg separator connected to a rear center of said base; said caster holders having casters connected thereto to facilitate sliding of said walker in different directions;

said walker being characterized in that said leg separator includes a perpendicular leg separating board, and an L-shaped fixing bar, which has a horizontal section connected at a front end to said base and a vertical section connected to a front end of said leg separating board; that said fixing bar is provided at the front end of said horizontal section with two first pin holes, and at the vertical section with at least two second pin holes; that said base is provided at the rear center with a lengthwise channel, in which said horizontal section of said fixing bar is located in place using insertion pins extended through said two first pin holes; that said leg separating board is provided at the front end with a vertical groove, with which said vertical section of said fixing bar is engaged using insertion pins extended through said at least two second pin holes; and that said leg separating board is provided along said front end with at least three through holes corresponding to different ones of said second pin holes on said fixing bar to allow adjustment of said leg separating board to different heights relative to said fixing bar.

2. The walker for rehabilitant as claimed in claim 1, wherein said base is provided above each said caster holder with a pivotally turnable direction control member, which has a front part shaped for enclosing two lateral sides of said caster holder when said direction control member is in a downward turned position, and said direction control member in said downward turned position being able to limit said caster holder, and accordingly said caster connected thereto, to move forward or backward only.

* * * * *